US006558221B1

(12) United States Patent
Yang

(10) Patent No.: US 6,558,221 B1
(45) Date of Patent: May 6, 2003

(54) DOLL HAVING FACE STENCIL AND STAMP APPLIED FEATURES

(75) Inventor: Tina Yang, Placentia, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/057,251

(22) Filed: Jan. 24, 2002

(51) Int. Cl.[7] ..... A63H 3/16
(52) U.S. Cl. ..... 446/100; 446/321
(58) Field of Search ..... 446/100, 321, 446/337; 434/84, 85, 87, 88, 99, 100

(56) References Cited

U.S. PATENT DOCUMENTS

| | | | | | |
|---|---|---|---|---|---|
| 2,950,537 | A | | 8/1960 | Fixen | |
| 3,234,681 | A | | 2/1966 | Lucia | |
| 3,783,553 | A | | 1/1974 | Goozner | |
| 3,863,386 | A | | 2/1975 | Kinberg | |
| 4,573,927 | A | | 3/1986 | Newman | |
| 4,836,783 | A | | 6/1989 | Harper | |
| 4,892,501 | A | | 1/1990 | Girelli | |
| 4,924,773 | A | * | 5/1990 | Gwilliam | 101/327 |
| 4,957,124 | A | * | 9/1990 | Mooney | 132/200 |
| 5,046,985 | A | | 9/1991 | Cearfoss | |
| 5,186,190 | A | * | 2/1993 | Hirzel | 132/319 |
| 5,195,893 | A | | 3/1993 | Casale | |
| 5,533,900 | A | | 7/1996 | Volk | |
| 5,586,500 | A | * | 12/1996 | Takami et al. | 101/327 |
| 5,732,627 | A | | 3/1998 | Imamaki | |
| 5,743,185 | A | * | 4/1998 | Hippely et al. | 101/327 |
| 5,865,305 | A | | 2/1999 | Yasoshima | |
| 5,939,142 | A | * | 8/1999 | Comiskey et al | 427/256 |
| 6,055,738 | A | | 5/2000 | Bardeen et al. | |
| 6,099,378 | A | | 8/2000 | George et al. | |
| 6,112,425 | A | | 9/2000 | Nelson et al. | |

* cited by examiner

*Primary Examiner*—Jacob K. Ackun
*Assistant Examiner*—Faye Francis
(74) *Attorney, Agent, or Firm*—Roy A. Ekstrand

(57) ABSTRACT

A doll includes a doll body supporting a head upon which a substantially blank featureless face surface is formed of a washable material. A stencil mask is configured to be received upon the face surface and defines a faceplate generally conforming to the blank face surface. The faceplate defines a plurality of shaped apertures located upon the faceplate to correspond to the general locations of facial features. A plurality of feature stamps, each having shaped flanges corresponding to the aperture shapes of the faceplate apertures support feature image stamps which may be passed through the apertures to imprint upon the face surface of the doll.

7 Claims, 3 Drawing Sheets

DOLL HAVING FACE STENCIL AND STAMP APPLIED FEATURES

FIELD OF THE INVENTION

This invention relates generally to dolls and toy figures and particularly to methods and apparatus for enhancing dolls and toy figures.

BACKGROUND OF THE INVENTION

Dolls and toy figures are perhaps among the oldest types of toys known and recorded in history. From initial simple handmade crude replicas of humans and animals through today's complex batter-powered electronically controlled and operated dolls and toy figures, a virtually unending development and improvement process has been in progress. Often the term "dolls" is utilized, for the most part, referring to human-like figures while the term "toy figures" is generally descriptive of a variety of additional figures both human-like and animal-like as well as action figures and fantasy figures. While the distinction between dolls and toy figures may have some purpose in many instances, with respect to the present invention, the term dolls as used herein refers and applies to virtually any type of doll or toy figure collectively. The invention relates generally particularly to dolls having facial features.

As dolls became commercial products, practitioner's in the toy arts endeavored to improve the interest and play value of such dolls. With the increasing and continuing popularity of dolls, practitioner's in the toy arts have produced a virtually endless variety of dolls. For example, U.S. Pat. No. 3,783,553 issued to Goozner sets forth a BLANK-FACED CHILD'S DOLL having a doll assembly which includes a stuffed doll body supporting a head which in turn supports a blank face portion of a single uniform color. The face portion is void of any facial features and is formed with slight concave depressions suggesting the locations of eyes and a mouth. The surface of the blank face portion is made to except the markings of crayons or similar nonpermanent drawing materials. As a result, a child user is able to draw facial features thereon. Such features are removable with a wiping cloth as desired.

U.S. Pat. No. 5,046,985 issued to Cearfoss sets forth a DOLL WITH A FACE FLAP OVERLYING A MARKABLE FACE PLATE which includes a permanently imprinted doll-face upon a flap overlying a blank face plate both of which are supported on the doll's head. When the flap is moved to its downward position the doll is played in a conventional manner. Conversely, the flap is raised, the blank face plate is revealed allowing the child user to draw face designs thereon.

U.S. Pat. No. 3,863,386 issued to Kinberg sets forth a READILY ERASABLE DOLL FACE ASSEMBLY having a doll body supporting a head portion in a substantially conventional fabrication. The head is further provided with a readily erasable face made from a sheet of translucent synthetic resin coated with or incorporating an iridescent dye. The iridescent dye is brought into intimate contract with the face plate under pressure and releasably adheres thereto. As a result, a child user is able to employ a conventional stylus or the like to draw erasable lines or features upon the face plate.

U.S. Pat. No. 4,573,927 issued to Newman sets forth MEANS AND METHOD OF SHOWING FEELINGS applicable to a doll form. The doll is configured to receive and support interchangeable faces having different expressions depicted thereon to provide expression of feelings.

U.S. Pat. No. 6,099,378 issued to George et al. sets forth a REALISTIC DOLL HEAD SYSTEM AND METHOD THEREFORE utilized in producing dolls having facial appearance of particular children. The user employs ten facial characteristics set forth in a chart to select those facial characteristics most closely resembling the facial appearance of a child. The facial characteristics that are selected comprise seven face shapes as well as variations of skin tone, eye color, eyelash color, eyebrow color and shape as well as hair color, cut, length and style. The selected characteristics are then applied to the doll head to produce a one of a kind doll closely resembling the selected child.

U.S. Pat. No. 4,982,501 issued to Girelli sets forth a DOLL'S HEAD AND METHOD OF FABRICATIONS utilizing a first sheet of polyester capable of stretching in two perpendicular directions together with a first lining of polyester fabric which are attached to opposite sides of a first thick sheet. In response to heat and pressure molding, a face portion of a doll and an integral neck extension are formed. The crown portion of the doll is sewn to the face portion and neck extension.

In a related art, U.S. Pat. No. 6,055,738 issued to Bardeen et al. sets forth a STENCIL AND KIT FOR TRANSFERRING IMAGES AND METHOD THEREFORE which is adapted for use in transferring image to a substrate where the image is formed by an ensemble of individual features. The stencil comprises a sheet of flexible material having a plurality of apertures formed therein. The apertures are organized in aperture sets such that the apertures in each set outline a respective individual feature. The aperture sets together define the predetermined image to be transferred. Examples are shown in transferring a stenciled image to objects such as a vegetable.

U.S. Pat. No. 6,112,425 issued to Nelson et al. sets forth a BOARDER, CORNER AND CUTOUT TEMPLATE for guiding a writing or cutting implement to form a plurality of patterns.

U.S. Pat. No. 5,865,305 issued to Yasoshimi sets forth a STENCIL CASE AND STENCIL SET IN A CASE which stores ink pads, stencil brushes and stencils. The case includes a base and a lid providing several ink pads storage slots for storing different colors of ink pads in parallel within the base.

U.S. Pat. No. 5,195,893 issued to Casale sets forth a SHAPE RETAINING STENCIL FOR THREE-DIMENSIONAL IMAGE PLACEMENT for use in placement of images upon non flat objects and surfaces. The stencil is formed of a shape retaining material on which a plurality of apertures defining a pattern have been formed. The material is placed against the non flat surface and marks are made through the apertures of the sheet onto the surface.

U.S. Pat. No. 2,950,537 issued to Fixen and U.S. Pat. No. 5,533,900 issued to Volk set forth examples of stencil kits.

U.S. Pat. No. 4,836,783 issued to Harper; U.S. Pat. No. 5,732,627 issued to Imamaki and U.S. Pat. No. 3,234,681 issued to De Lucia set forth various activity set materials having general relationship to the present invention.

While the foregoing described prior art devices have to some extent improved the art and have in some instances enjoyed commercial success, there remains nonetheless a continuing need in the art for evermore improved, interesting and amusing doll's and doll center play sets.

SUMMARY OF THE INVENTION

Accordingly, it is a general object of the present invention to provide an improved doll. It is a more particular object of the present invention to provide an improved doll having an associated play set which facilitates changing or augmenting the features of the doll. It is a still more particular object of the present invention to provide an improved doll having changeable features which is particularly suited for use by young children.

In accordance with the present invention there is provided a doll comprising: a doll body having a head defining a face surface; a stencil mask having a faceplate shaped to generally overlie the face surface and defining a plurality of apertures; and a plurality of feature stamps each having a raised image of a feature to form a stamp for imprinting a facial feature when the feature stamp is moved through one of the apertures to contact the face surface, the stencil mask functioning to locate the imprinting of facial features upon the face surface.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
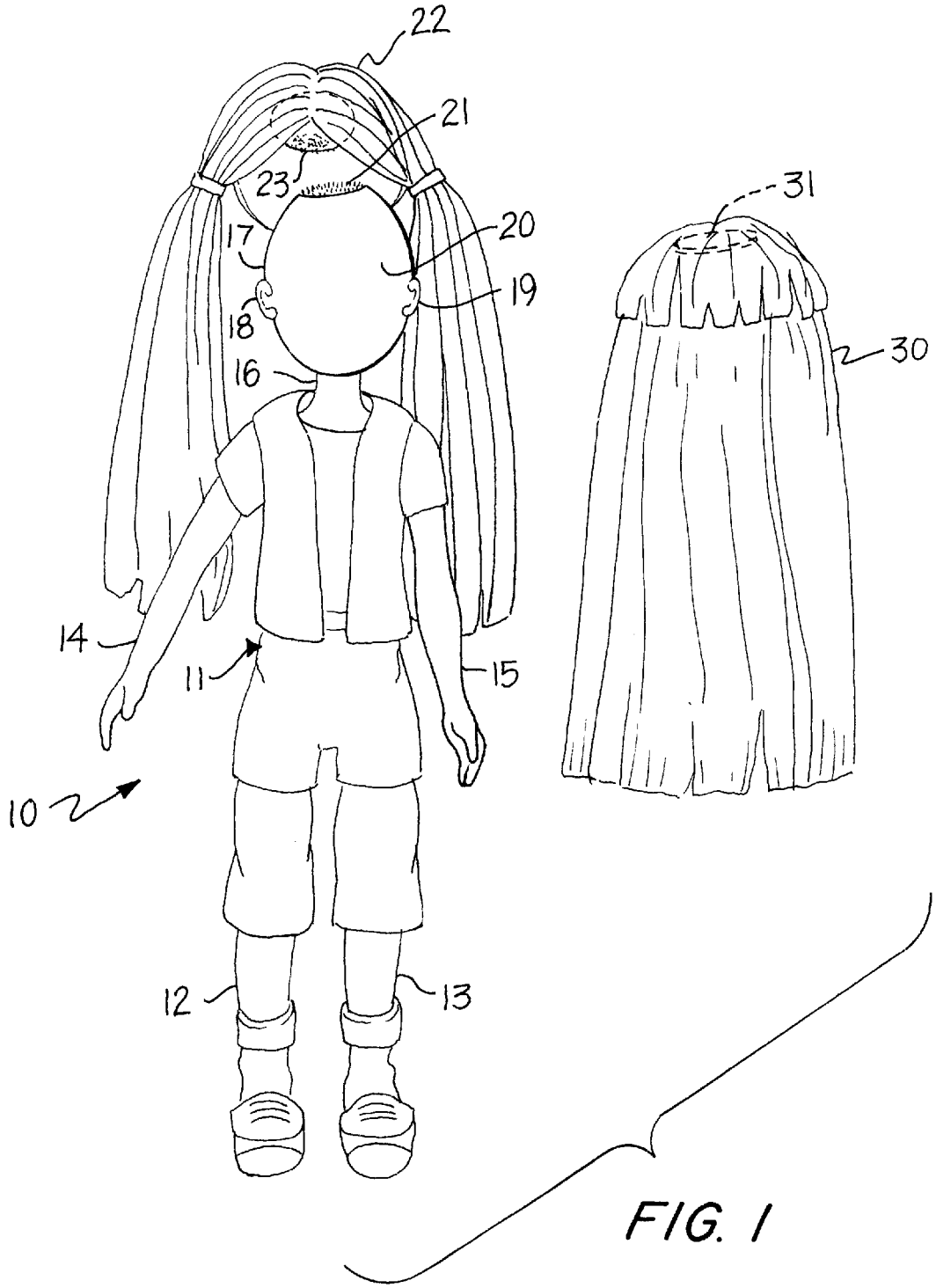
FIG. 1 sets forth a perspective assembly view of a doll constructed in accordance with the present invention.

FIG. 1 sets forth a perspective assembly view of a doll constructed in accordance with the present invention and generally referenced by numeral 10. Doll 10 includes a doll body 11 supporting a pair of legs 12 and 13 together with a pair of arms 14 and 15. Doll 10 further includes an upwardly extending neck 16 supporting a head 17. Head 17 defines a face surface 20 and supports a pair of ears 18 and 19 and an attachment pad 21 on the upper surface of head 17. Doll 10 further includes a hair piece 22 having an attachment pad 23 secured to the interior crown portion thereof.

Figure 10:
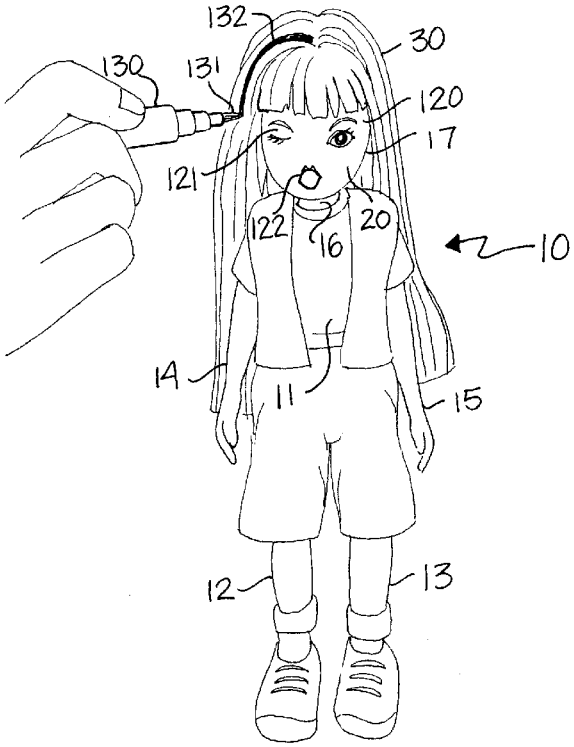
FIG. 10 sets forth a perspective view of the present invention doll having hair coloring applied thereto.

Also shown in FIG. 1, in combination with doll 10, is an alternative hair piece 30 which includes an attachment pad 31 secured therein. Both hair pieces 30 and 22 are configured to be received upon head 17 and positioned generally as shown in FIG. 10. It will be understood that hair pieces 22 and 30 are interchangeable and provide different hair styles for doll 10.

Body 11 together with legs 12 and 13 and arms 14 and 15 may be fabricated in accordance with conventional fabrication techniques. Similarly, neck 16 together with head 17 apart from face surface 20 and attachment pad 21 may also be fabricated in accordance with conventional fabrication techniques. Face surface 20 is, in accordance with an important aspect of the present invention, preferably formed to define a generally convex surface either completely free of facial aspects or substantially free of facial contours and aspects. In addition, face surface is preferably formed of a washable type material such as plastic or the like which allows ink to be applied thereto in the manner set forth below and facilitates washing such ink from face surface 20. For example, face surface 20 may be fabricated of a conventional washable plastic material or alternatively may be fabricated of a cloth fabric upon which a suitable nonabsorbent coating has been applied.

In accordance with a further aspect of the present invention, the use of interchangeable hair pieces such as hair pieces 22 and 30 facilitate changing the apparent hairstyle for doll 10. In each case, an attachment pad 21 adheres to cooperating attachment pad 23 to secure to hair piece 22 or alternatively to attachment pad 31 to secure alternate hair piece 30. In the preferred fabrication of the present invention, attachment pad 21 may comprise one portion of a conventional hook-and-loop fabric attachment apparatus while attachment pads 23 and 31 comprise corresponding cooperating attachment pads of hook-and-loop fastening devices.

Figure 2:
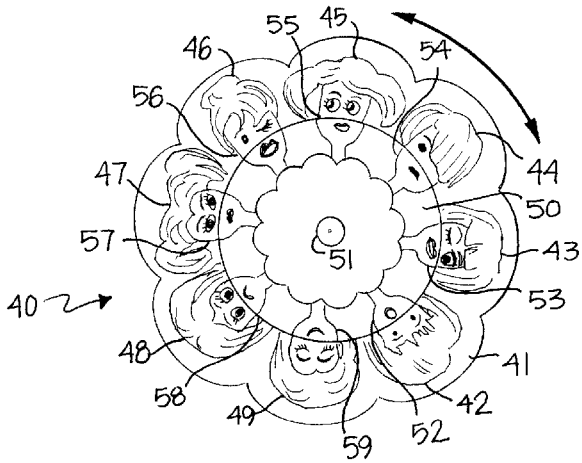
FIG. 2 sets forth an accessory for use in combination with the present invention doll.

FIG. 2 sets forth a feature wheel constructed in accordance with the present invention and generally referenced by numeral 40. Feature wheel 40 includes an outer ring 41 upon which a plurality of upper head portions 42 through 49 are imprinted. Head portions 42 through 49 are radially oriented and are generally centered at equal angular space therebetween. Feature wheel 40 further includes an inner ring 50 rotatably supported with respect to outer ring 41 by a center pin 51. Inner ring 50 supports a corresponding plurality of lower head and neck portions 52 through 59. Lower head and neck portions 52 through 59 are also radially oriented and generally equally spaced at equal angles about inner ring 50.

Each of upper head portions 42 through 49 and lower head and neck portions 52 through 59 support different facial features such that rotation of outer ring 41 with respect to inner ring 50 or rotation of inner 50 with respect to outer ring 41 in either direction as indicated by arrows 60 allows different combined images to be formed by the combination of upper head portions 42 through 49 with lower head and neck portions 52 through 59. This results in producing a variety of combined or composite faces which the child user may employ in selecting features to be used with the present invention doll.

Figure 3:
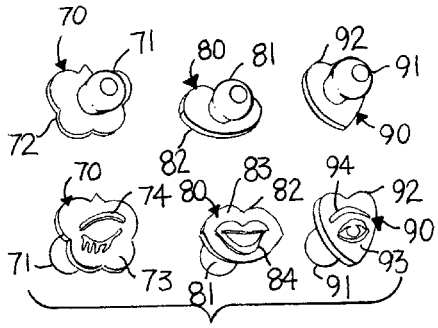
FIG. 3 sets forth perspective views of a plurality of doll facial feature stamps utilized in the present invention.

FIG. 3 sets forth perspective views of a plurality of feature stamps 70, 80 and 90, each shown from the front and reverse sides. It will be apparent to those skilled in the art, that feature stamps 70, 80 and 90 are provided solely for purposes of illustration and that a variety of different styles of feature stamps having different images thereon may be utilized in combination with the present invention doll without departing from the spirit and scope of the present invention.

More specifically, feature stamp 70 includes a handle 71 secured to a flange 72. Flange 72 defines a feature surface 73 upon which a raised image 74 is formed. It will be noted that flange 72 defines a multiply contoured outer edge, the importance of which will be described below in greater detail. Suffice it to note here, that the outer edge shape of flange 72 provides for unique positioning of feature stamp 70 in the manner described below.

Feature stamp 80 includes a handle 81 secured to a flange 82. Flange 82 supports a feature surface 83 upon which a raised image 84 is formed. Once again, it will be noted that flange 82 defines a unique outer edge shape.

Feature stamp 90 includes a handle 91 secured to a flange 92. Flange 92 defines a feature surface 93 upon which a raised image 94 is formed. Once again, it will be noted that flange 92 defines a unique outer edge shape or configuration.

Figure 4:
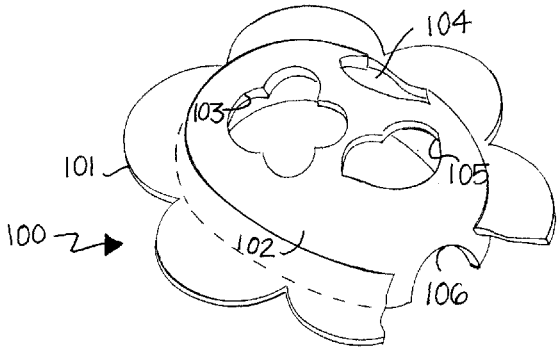
FIG. 4 sets forth a perspective view of a stencil mask of the present invention doll.

FIG. 4 sets forth a perspective view of a stencil mask constructed in accordance with the present invention and generally referenced by numeral 100. Stencil mask 100 includes an outer boarder 101 and a generally curved face plate 102. Face plate 102 in its preferred form, defines a general contour corresponding to front surface 20 of head 17 (seen in FIG. 1). Face plate 102 defines a plurality of apertures 103, 104 and 105. Face plate 102 further defines a neck locating notch 106.

In operation, face plate 102 is shaped and contoured to generally fit upon face surface 20 of head 17 of doll 10 (seen in FIG. 1). The positioning of faceplate 102 upon the face surface of the cooperating doll is provided by the cooperation of neck locating notch 106 upon neck 16 of doll 10 (seen in FIG. 5). Thus, stencil mask 100 is positioned upon face surface 20 in the manner described below to position face plate 102 upon front surface 20 (seen in FIG. 5). This positioning also places apertures 103 through 105 in overlying position upon front surface 20 of doll head 17.

Figure 5:
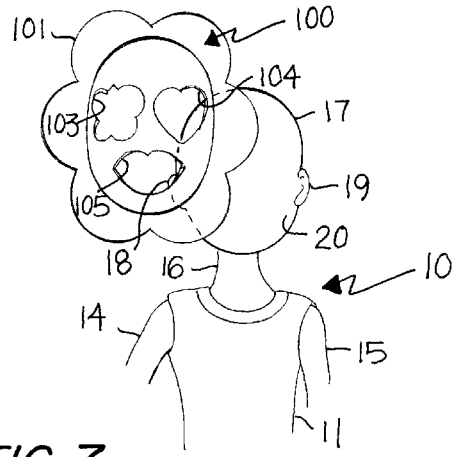
FIG. 5 sets forth a perspective view of the present invention stencil mask during assembly to the present invention doll.

FIG. 5 sets forth a perspective assembly view of doll 10 and stencil mask 100 in a typical use thereof. Thus, as described above, doll 10 includes a body 11 having arms 14 and 15 together with a neck 16. A head 17 having ears 18 and 19 and defining a front surface 20 is supported upon neck 16. A stencil mask 100 having a faceplate 102 supported by a border 101 is positioned upon front surface 20 in an overlying relationship. The appropriate positioning of stencil mask 100 upon head 17 and particularly face surface 20 is provided by the interaction of neck locating notch 106 (seen in FIG. 4) together with neck 16. Face plate 102 defines a plurality of uniquely shaped apertures 103, 104 and 105. As will be apparent to those skilled in the art, apertures 103 and 104 are generally positioned to provide locations for eye images upon face surface 20 while aperture 105 is generally positioned to provide location of a mouth feature upon face surface 20. It will also be apparent to those skilled in the art, that aperture 103 is shaped to uniquely to receive and orient stamp 70 (seen in FIG. 3) while aperture 104 is uniquely shaped and configured to receive and orient stamp 90 (also seen in FIG. 3). Similarly, it will be apparent that aperture 105 is shaped and configured to receive and orient stamp 80 (seen in FIG. 3).

Figure 6:
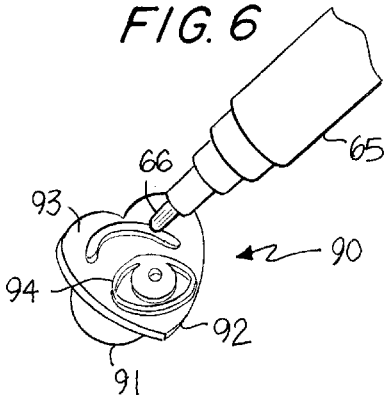
FIG. 6 sets forth a perspective view of a feature stamp having a typical ink transfer process being applied in preparation for the feature stamping of the present invention doll.

FIG. 6 sets forth a partial perspective view showing the application of ink to a feature stamp 90. It will be understood that as an alternative to the inking process shown in FIG. 6, a conventional stamp pad may be used. In the operation of Figure feature stamp 90 having handle 91 and flange 92 is positioned such that surface 93 and raised image 94 are accessible. A conventional ink marker 65 having a marker tip 66 is used to transfer ink to the elements of raised image 94. In the example shown in FIG. 6 using feature stamp 90, raised image 94 includes and eyebrow element together with an open eye element. It will be apparent to those skilled in the art however, that different raised images may be utilized in the same manner and may be inked in accordance with the operation shown in FIG. 6.

Figure 7:
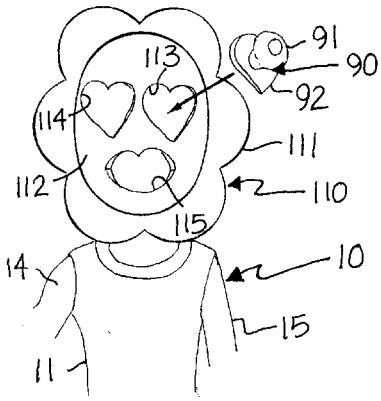
FIG. 7 sets forth a perspective view of the present invention stencil mask and associated feature stamp used upon the present invention doll.

FIG. 7 sets forth a front perspective view of doll 10 having stencil mask 110 supported thereon during a typical feature application process. More specifically, doll 10 includes a body 11 supporting arms 14 and 15. A stencil mask 110 having a boarder 111 and a face plate 112 is positioned upon face surface 20 of doll 10. Stencil mask 110 is substantially identical to stencil mask 100 shown above in FIG. 4 with the difference being found in an alternative combination of apertures formed in faceplate 112. With the exception of an alternative set of stamp locating apertures in faceplate 112, stencil mask 110 will be understood to be substantially identical in structure and operation to stencil mask 100 described above. Thus, faceplate 112 defines a pair of apertures 113 and 114 which are substantially identical to aperture 104 formed in stencil mask 100 (seen in FIG. 4). In addition, faceplate 112 defines an aperture 115 substantially identical to aperture 105 shown in stencil mask 100 (seen in FIG. 4).

With stencil mask 110 positioned upon doll 10 and overlying face surface 20 thereof, the user is able to uniquely locate and stamp a plurality of selected facial feature images upon surface 20 in the manner illustrated in FIG. 7. By way of example, a feature stamp 90 having a handle 91 and a flange 92 which is described above in FIG. 3 in greater detail, is oriented such that flange 92 is properly aligned with aperture 113. Thereafter, feature stamp 90 is moved to position flange 92 within aperture 113. The unique shape and contour of both flange 92 and aperture 113 provides the desired rotational and positional alignment of feature stamp 90 upon face surface 20. The user thereafter, presses feature stamp 90 inwardly upon face surface 20 to imprint the selected facial feature upon face surface 20.

The user may then re-ink feature stamp 90 and utilize the same process upon aperture 114 to imprint a second eye feature upon face surface 20. Finally, the feature set selected for doll 10 in the example in FIG. 7, may be completed by employing feature stamp 80 (seen in FIG. 3) in cooperation with aperture 115 in the above described manner to imprint a mouth image upon face surface 20.

Figure 8:
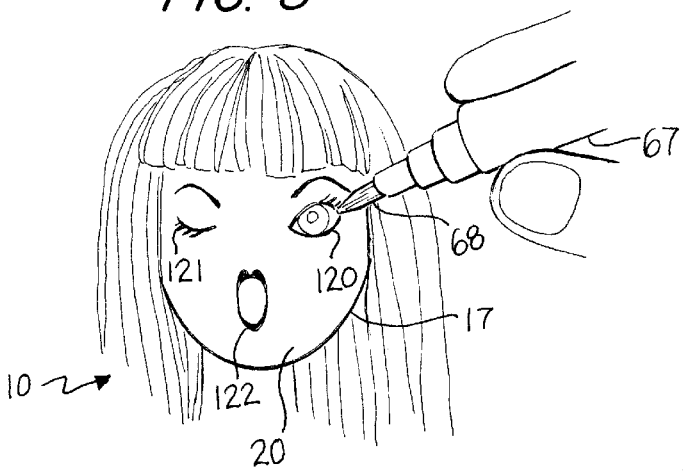
FIG. 8 sets forth a partial perspective view of the facial portion of the present invention doll.

FIG. 8 sets forth a partial front view of doll 10 having a combination of facial images imprinted thereon utilizing the present invention stencil mask and selected feature stamps. In the example of FIG. 8, stencil mask 100 shown in FIG. 5, has been used together with feature stamps 70, 80 and 90 (seen in FIG. 3). Thus, as seen in FIG. 8, doll 10 includes a neck 16 supporting a head 17 having a face surface 20 upon which an eye image 120 together with an alternative eye image 121 has been imprinted. Similarly, a mouth image 122 has also been imprinted upon face surface 20.

FIG. 8 also illustrated a further augmentation or enhancement of the facial images upon face surface 20 using a pen 67 having a marking tip 68. In the operation shown in FIG. 8, pen 67 is used to provide a colored enhancement of eye image 120 in the form of the eye make-up process commonly referred to as "eye shadow". It will be apparent to those skilled in the art however, that a variety of pens having different colors may be utilized to provide various enhancements of the feature images stamped upon face surface 20 without departing from the spirit and scope of the present invention.

Figure 9:
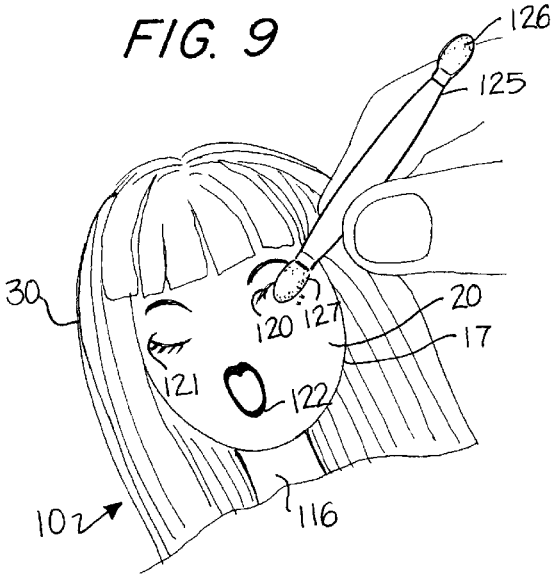
FIG. 9 sets forth a partial perspective view of the present invention doll having the stamped facial features thereon being removed.

FIG. 9 sets forth a partial front view of doll 10 illustrating the initiating a feature removal process. As illustrated in FIG. 9, the various stamped feature images upon face surface 20 may be washed therefrom to allow the child user to apply a further variation of features and change the appearance of doll 10. Thus, doll 10 includes a neck 16 supporting a head 17 having a face surface 20 thereon. Doll 10 further includes a hair piece 30 supported upon head 17. Face surface 20 is shown in FIG. 9 having eye images 120 and 121 together with a mouth image 122. To illustrate the clean-up or washable feature of the present invention, a cleaner 125 having a pair of absorbent pads 126 and 127 at each end thereof is shown removing eye image 120. It will be recalled that face surface 20 is preferably formed of a washable material and that the ink utilized in imprinting facial feature images upon surface 20 is similarly of a washable character. Thus, pad 127 of cleaner 125 is preferably saturated or moistened with an appropriate solvent or cleaner allowing eye image 120 to be easily removed. The selection of solvent or cleaner for use with cleaner 125 is determined by the characteristics of ink utilized. If for example, a washable ink having water solubility is employed, then pad 127 is simply moistened with a quantity of water which readily dissolves image 120. Alternatively, ink or stamping compositions may be utilized in imprinting the feature images upon surface 20 which require an alternative solvent such as alcohol or the like. In such case, pad 127 is moistened with a quantity of alcohol or the like to provide suitable washable capability.

Thus, it will be apparent that the present invention doll may be provided with a plurality of different facial feature combinations in successive order to change the appearance or facial expression of the present invention doll. The process is substantially enhanced by the utilization of the appropriate stencil mask and feature stamp combination. Each feature set may then be removed by simple washing to allow the application of an alternative feature set.

FIG. 10 sets forth a perspective view of the present invention doll utilizing a hair coloring application to further enhance the variable appearance of the doll. As described above, doll 10 includes a body 11 supporting legs 12 and 13 together with arms 14 and 15. Body 11 further supports a neck 16 which in turn supports a head 17 having a face surface 20 formed thereon. A hairpiece 30 is received upon head 17 in the manner described above in FIG. 1. In accordance with the present invention described above, a plurality of stamped features 120, 121 and 122 are imprinted upon surface 20 of head 17. To further vary the appearance of doll 10, a marker 30 having a tip 131 is applied to hairpiece 30 to create an alternate color area 132.

What has been shown is an improved doll having a generally conventional body and a substantially blank generally featureless face surface. A cooperating mask having a plurality of locating apertures formed therein is positionable upon the face surface of the doll and facilitates the unique location and orientation of a feature stamp. The feature stamp utilizes a ink stamping process to allow the user to imprint an image upon the facial surface. The facial surface is washable facilitating the repeated removal and reapplication of stamped feature images upon the doll face to vary the doll's appearance.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a doll body having a head defining a face surface;

a stencil mask having a faceplate shaped to generally overlie said face surface and defining a plurality of apertures; and a plurality of feature stamps each having a raised image of a feature to form a stamp for imprinting a facial feature when said feature stamp is moved through one of said apertures to contact said face surface, said stencil mask functioning to locate the imprinting of facial features upon said face surface.

2. The doll set forth in claim 1 wherein said apertures each defining an aperture shape and wherein said plurality of feature stamps are each configured to pass through at least one of said apertures and to be unable to pass through at least one of said apertures.

3. The doll set forth in claim 2 wherein said plurality of feature stamps each include a flange having a shape corresponding to at least one of said apertures to configure each of said feature stamps.

4. A doll comprising:

a doll body having a neck;

a head supported on said neck and having a generally convex face surface thereon;

a stencil mask having a generally convex faceplate conforming generally to said face surface, said faceplate defining a plurality of apertures each having a characteristic shape;

a plurality of feature stamps each having a portion shaped to fit through at least one, but not all, of said apertures each having a raised stamp image forming a facial feature; and means for inking said raised stamp image, said stencil mask being placed upon said head such that said apertures each overlie a portion of said face surface and said feature stamps being selectively moved through selected apertures to imprint a feature image upon said face surface.

5. The doll set forth in claim 4 wherein said stencil mask defines a locating notch cooperating with said neck to orient said stencil mask with respect to said face surface.

6. The doll set forth in claim 5 wherein said face surface is formed of a washable material.

7. A method of doll play comprising the steps of:

providing a doll having a generally featureless face surface formed of a washable material;

providing a stencil mask having a faceplate defining a plurality of shaped apertures;

providing a plurality of inked feature stamps each shaped to pass through at least one of said shaped apertures;

placing said stencil mask over said face surface;

extending one of said inked feature stamps through one of said apertures to imprint a feature image upon said face surface and withdrawing said one feature stamp;

repeating said extending step using a different feature stamp and different aperture to imprint another image on said face surface; and removing said stencil mask.

* * * * *